United States Patent [19]

Meyer et al.

[11] Patent Number: 4,614,890

[45] Date of Patent: Sep. 30, 1986

[54] HIGH INTENSITY DISCHARGE LAMP ALKALI METAL LOSS REDUCTION MEANS

[75] Inventors: Vincent D. Meyer, Hamilton; William M. Keeffe, Rockport, both of Mass.

[73] Assignee: GTE Products Corporation, Danvers, Mass.

[21] Appl. No.: 607,550

[22] Filed: May 7, 1984

[51] Int. Cl.[4] ..... H01J 1/02

[52] U.S. Cl. ..... 313/25; 313/634

[58] Field of Search ..... 313/25, 44, 634, 22, 313/638, 24, 639, 641

[56] References Cited

U.S. PATENT DOCUMENTS 3,250,934 5/1966 Peterson ..... 313/17
3,384,775 5/1968 Ishler et al. ..... 313/639
3,610,983 10/1971 Grabner et al. ..... 313/25
4,499,396 2/1985 Fohl et al. ..... 313/25

FOREIGN PATENT DOCUMENTS 0136450 10/1980 Japan ..... 313/25

*Primary Examiner*—David K. Moore
*Attorney, Agent, or Firm*—José W. Jimenez; Thomas H. Buffton

[57] ABSTRACT

A high intensity discharge lamp includes a hermetically sealed outer envelope having an arc tube therein containing a fill gas which includes sodium and having a wall member with a portion of increased thickness wherein the portion of increased thickness of the wall member of the arc tube is positioned adjacent to a metal conductor disposed within the outer envelope whereby loss of sodium from the arc tube is inhibited.

13 Claims, 4 Drawing Figures

HIGH INTENSITY DISCHARGE LAMP ALKALI METAL LOSS REDUCTION MEANS

TECHNICAL FIELD

This invention relates to sodium losses in high intensity discharge lamps and more particularly to high intensity discharge lamp configurations for reducing sodium metal losses in such lamps.

BACKGROUND ART

Generally, high intensity discharge lamps such as high pressure sodium lamps and metal halide discharge lamps include an outer envelope containing an arc tube having sodium therein and a metal conductor positioned adjacent the arc tube. Also, it has long been known that arc tubes which contain sodium have a tendency to loose this sodium during the operational use of the discharge lamp.

Previous measurements have shown that sodium loss in high intensity discharge lamps results from electrolytic action induced by a surface charge of photoelectrons emitted from a metal conductor and building up on the wall surface of the arc tube. Also, it is known that this loss of sodium results in darkening of the outer envelope as well as a shortened lamp life period. Moreover, it has been determined that the rate of sodium loss is dependent upon the magnitude of the electric field across the wall of the arc tube as well as the operational temperature of the wall of the arc tube.

One prior known attempt to reduce sodium loss from the arc tube of a high intensity discharge lamp such as a metal halide lamp involves the utilization of a so-called "frameless construction". Herein, there are no side rods along the arc tube which tend to reduce photoelectron emission and electrolytic action of the sodium. However, the configuration does require a relatively long tungsten or molybdenum current return from the distal end of the arc tube to the stem associated with the outer envelope. Unfortunately, such a current return construction can lead to fractures of the stem and tube failure due to increased strain caused by the relatively long current return. Moreover, such current return material is expensive and also necessitates a relatively large outer envelope.

Also, sodium loss in high pressure sodium (HPS) lamps has been minimized by restricting the pressure of the sodium in the arc tube and by providing an excess sodium fill. However, restricting the pressure within the arc tube seriously restricts the color rendering capabilities of the lamp. Also, excess sodium fill results in lamp operation in a saturated vapor phase which is controlled by cold spot temperature and as a result the lamp is subject to voltage rise and shortened operational life.

OBJECTS AND SUMMARY OF THE INVENTION

It is an object of the present invention to provide a structure which obviates the above-listed deficiencies of the prior art. Another object of the invention is to provide an improved high intensity discharge lamp. Still another object of the invention is to improve the operational capabilities of high intensity discharge lamps by reducing the sodium loss in such structures. A further object of the invention is to enhance the sodium-retaining capabilities of the arc tube of a high intensity discharge lamp. A still further object of the invention is to provide a high pressure sodium lamp operational at higher sodium pressures because of the reduced losses of sodium.

These and other objects, advantages and capabilities are achieved in one aspect of the invention by a high intensity discharge lamp having an outer envelope containing a metal conductor and an arc tube with sodium therein and having a portion of increased wall thickness positioned adjacent the metal conductor.

BEST MODE FOR CARRYING OUT THE INVENTION

For a better understanding of the present invention, together with other and further objects, advantages, and capabilities thereof, reference is made to the following disclosure and appended claims in conjunction with the accompanying drawings.

Figure 1:
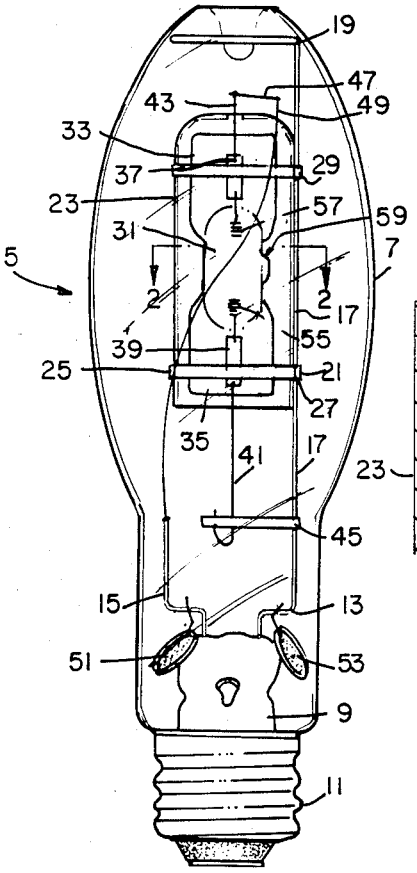
FIG. 1 is a high intensity discharge lamp illustrating an embodiment of the invention.

Referring to FIG. 1 of the drawings, a low wattage metal halide arc discharge lamp 5 includes an evacuated outer envelope 9 hermetically sealed to a glass stem member 9 and having an external base member 11 affixed thereto. A pair of electrical conductors 13 and 15 are sealed into and pass through the stem member 9 and provide access for energization of the discharge lamp 5 by an external source (not shown).

Within the vacuum of the evacuated outer envelope 7, a support member 17 is affixed to one of the electrical conductors 13 and extends substantially parallel to the longitudinal axis of the lamp 5 and forms a circular configuration 19 near the upper portion of the envelope 7. This circular configuration 19, in conjunction with the upper portion of the envelope 7, tends to maintain the support member 17 in proper alignment and resistant to deformation caused by external shock.

A first strap member 21 is welded to the support member 17 and extends therefrom in a direction normal to the longitudinal axis of the support member 17. A domed quartz sleeve 23 has a pair of oppositely disposed notches 25 and 27 on the end thereof 17 opposite to the dome portion. These notches 25 and 27 are formed to slip over the first strap member 21 which serves to support the domed quartz sleeve 23. Also, a substantially circular-shaped strap 29 surrounds the domed quartz sleeve 23 near the dome portion thereof and is attached to the support member 17.

Within the domed quartz sleeve 23 is an arc tube 31. The arc tube 31 has a pinch seal at opposite ends thereof, 33 and 35 respectively. Metal foil members 37 and 39 are sealed into the press seals 33 and 35 and electrical conductors 41 and 43 are attached to the foil members 37 and 39 and extend outwardly from the press seals 33 and 35. A flexible support member 45 is affixed to one of the electrical conductors 41 and to the support member 17. Also, lead 47 is affixed to the other electrical conductor 43 which passes through the dome portion of the dome quartz sleeve 23. Moreover, a flexible spring-like member 49 connects the lead 47 to the other one 15 of the pair of electrical conductors 13 and 15. A pair of getters 51 and 53 are affixed to the electrical conductors 13 and 15 and serve to provide and maintain the vacuum within the evacuated outer envelope 7 and the dome quartz sleeve 23. Moreover, a pair of electrodes 55 and 57 project into opposite ends of the arc tube 31.

Referring more specifically to the arc tube 31, it is to be noted that each of the ends thereof immediately adjacent and including the press seals 33 and 35 is coated with a white zirconium oxide paint in order to provide a wall temperature of increased uniformity. Also, the arc tube 31 contains a starting gas, mercury and a scandium and sodium halide. Moreover, other metal halides are suitable to the structure.

Importantly, the arc tube 31 includes a portion of increased wall thickness 59 which is positioned immediately adjacent the support member 17. This support member 17, which is in the form of a metal conductor, extends substantially parallel to the longitudinal axis of the lamp 5 and of the arc tube 31. Thus, the portion of increased wall thickness 59 of the arc tube 31 faces and parallels the metal conductor 17.

Figure 2:
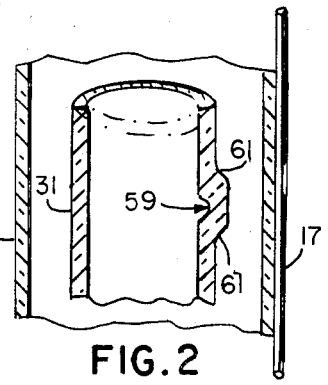
FIG. 2 is an isometric view of the embodiment of FIG. 1.

As can better be seen in the isometric illustration of FIG. 2, the arc tube 31 has a wall member with an increased thickness portion 59. Preferably, this increased thickness portion 59 is the area of tip-off of the arc tube 31 and includes a pair of wing-like members 61 of increased wall thickness which extend along a longitudinal axis parallel to the direction of the metal conductor 17. Also, this increased thickness portion 59 and the wing-like members 61 are positioned immediately adjacent the metal conductor 17. Thus, sodium loss from the arc tube 31 to the metal conductor 17 is inhibited by the increased thickness portion 59 and wing-like members 61.

Figure 3:
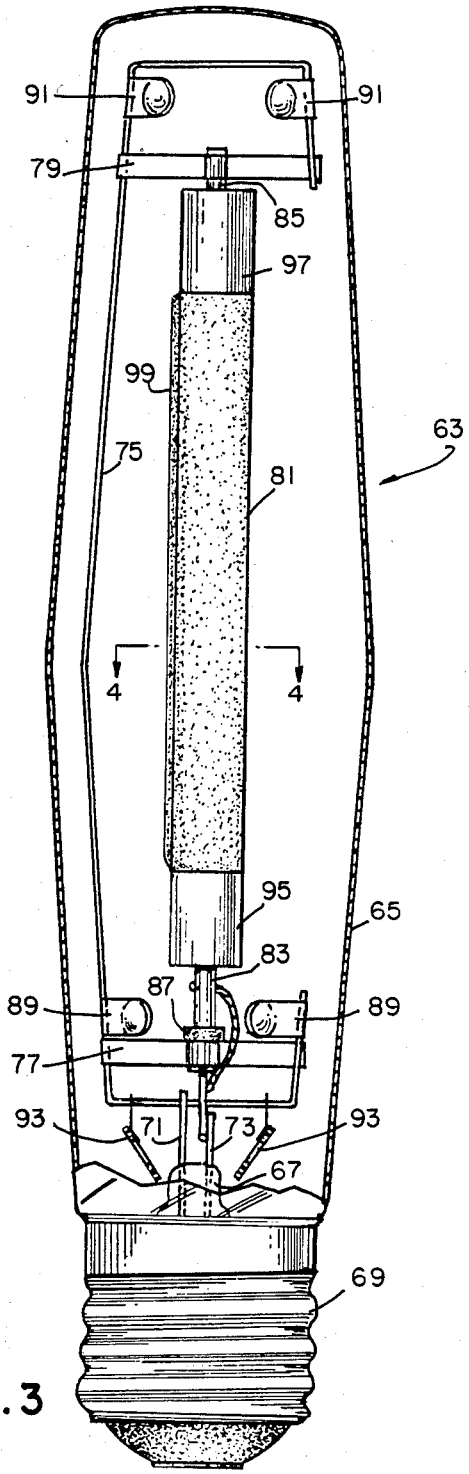
FIG. 3 is an alternate configuration of a high intensity discharge lamp illustrating the invention.

Alternately, FIG. 3 illustrates a high pressure sodium lamp 63 having an outer envelope 65 hermetically sealed to a stem portion 67 and having a base member 69 affixed to the outer envelope 65. A pair of electrical leads 71 and 73 are sealed into and pass through the stem portion 67 to provide access for energy from an energizing source (not shown). Disposed within the envelope 65 and affixed to one of the electrical leads 71 is a support member 75 in the form of a metal conductor extending substantially parallel to the longitudinal axis of the envelope 65. Also, a pair of electrically conductive cross members, 77 and 79 respectively are affixed to opposite ends of the support member 75 and extend in a direction substantially normal to the longitudinal axis of the envelope 65.

Located within the envelope 65 is an elongated substantially cylindrical arc tube 81 of a light transmissive ceramic material such as polycrystalline alumina for example. A pair of electrical conductors 83 and 85 are sealed into and extend outwardly from the ends of the arc tube 81. One of these electrical conductors 83 is supported within a ceramic member 87 affixed to the cross member 77 and electrically connected to the electrical lead 73. The other electrical conductor 85 is electrically connected to the cross member 79 and by way of the electrically conductive support member 75 to the electrical lead 71. Pairs of flexible tensioning members 89 and 91 are attached to opposite ends of the support member 75 and serve to insure the positioning of the arc tube 81 witin the envelope 65. Moreover, one or more getters 93, preferably barium, are disposed within the envelope 65 which is preferably evacuated.

The arc tube 81 has a pair of heat insulating sleeves 95 and 97 affixed to opposite ends thereof in the vicinity of electrodes (not shown) within the arc tube 81. Also, a fill gas, which includes sodium and usually mercury, is disposed within the arc tube 81.

Figure 4:
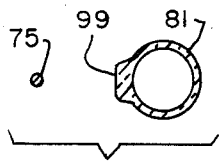
FIG. 4 is a cross-sectional view of the embodiment of FIG. 3.

Importantly, the arc tube 81 has a portion 99 thereof of increased wall thickness and this portion of increased wall thickness 99 is positioned adjacent the metal conductor 75. As can more readily be seen in the cross-sectional view of FIG. 4, the arc tube 81 has a wall portion of increased thickness 99 and this portion of increased wall thickness 99 is positioned adjacent the electrical conductor 75 extending substantially parallel to the longitudinal axis of the envelope 65.

Accordingly, it has been found that orienting the portion of the arc tube with increased wall thickness 59 and 99 on the side of and adjacent to the metal conductor, 17 and 75 of FIGS. 1 and 3, significantly reduces the loss of sodium from the arc tube during the operational period of the discharge lamp. Obviously, it is the relationship of the increased wall thickness of the arc tube and the metal conductor which are significant factors. Although numerous theories have been advanced for this reduction in loss of sodium from the arc tube such as a reduction in the temperature of the wall of increased thickness in the region of the metal conductor, reduced convective flow from the arc tube to the metal conductor due to the increased wall thickness and increased bow between the metal conductor and the arc tube at the area of increased wall thickness, a definitive reason has not been established. However, the reduction in sodium loss from the arc tube when the wall portion of increased thickness is oriented toward the extracting electric field or metal conductor has been established.

Accordingly, this reduction in sodium loss in high pressure sodium lamps is especially evident in the so-called high pressure sodium lamps having a relatively high CRI (color rendering index). Therein, high CRI type high pressure sodium lamps frequently have a pressure in the range of about 250 torr and a reduction in sodium loss permits the fabrication of structures employing a pressure of about 250 torr.

While there has been shown and described what is at present considered the preferred embodiments of the invention, it will be obvious to those skilled in the art that various changes and modifications may be made therein without departing from the invention as defined by the appended claims.

We claim:

1. A high intensity discharge lamp comprising a hermetically sealed outer envelope, an arc tube containing sodium, having a portion of increased wall thickness and disposed within said envelope and a metal conductor located within said outer envelope and positioned immediately adjacent said portion of increased wall thickness of said arc tube whereby loss of sodium from said arc tube is reduced.

2. The high intensity discharge lamp of claim 1 wherein said portion of increased wall thickness of said arc tube is in the form of a tip-off portion in the plane of a press seal with said press seal having wings extending substantially along said metal conductor.

3. The high intensity discharge lamp of claim 1 wherein said portion of increased wall thickness of said arc tube is in the form of a tip-off portion oriented toward said metal conductor.

4. The high intensity discharge lamp of claim 1 wherein said arc tube is substantially cylindrical-shaped with a longitudinal axis and said portion of increased wall thickness of said arc tube extends along said longitudinal axis adjacent said metal conductor.

5. The high intensity discharge lamp of claim 1 wherein said lamp is in the form of a high pressure sodium lamp.

6. The high intensity discharge lamp of claim 1 wherein said lamp is in the form of a high pressure sodium lamp having a high color rendering index (CRI) and operational at a sodium pressure in the range of about 250 torr.

7. The high intensity discharge lamp of claim 1 wherein said lamp is in the form of a metal halide discharge lamp.

8. The high intensity discharge lamp of claim 1 wherein said lamp is in the form of a low wattage metal halide discharge lamp.

9. The high intensity discharge lamp of claim 1 wherein a domed quartz bottle is telescoped over said arc tube and includes a portion positioned intermediate said arc tube and said metal conductor.

10. In a high intensity discharge lamp having a hermetically sealed outer envelope the improvement comprising an arc tube containing sodium and having a wall member with a portion of increased thickness, a metal conductor disposed within said outer envelope and positioned intermediate thereto and said arc tube and means for orienting said arc tube to align said portion of increased thickness of said wall member immediately adjacent said metal conductor whereby sodium losses from said arc tube are reduced.

11. The improvement of claim 10 wherein said portion of increased thickness of said wall member of said arc tube is in the form of a tip-off portion having lateral wings extending in a direction substantially parallel to said metal conductor.

12. The improvement of claim 11 wherein said portion of increased thickness of said wall member of said arc tube is in the form of a tip-off portion positioned immediately adjacent said metal conductor.

13. The improvement of claim 11 wherein said lamp is a high pressure sodium lamp having a high CRI (color rendering index) and a sodium pressure in the range of about 250 torr.

* * * * *